US008922604B2

(12) United States Patent
Nakamura et al.

(10) Patent No.: US 8,922,604 B2
(45) Date of Patent: Dec. 30, 2014

(54) IMAGE-DISPLAY DEVICE AND CONTROL METHOD OF SAME

(75) Inventors: Tatsunori Nakamura, Osaka (JP); Shigeki Imai, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 267 days.

(21) Appl. No.: 13/580,673

(22) PCT Filed: Nov. 19, 2010

(86) PCT No.: PCT/JP2010/070664

§ 371 (c)(1), (2), (4) Date: Aug. 23, 2012

(87) PCT Pub. No.: WO2011/118083

PCT Pub. Date: Sep. 29, 2011

(65) Prior Publication Data

US 2012/0313987 A1 Dec. 13, 2012

(30) Foreign Application Priority Data

Mar. 26, 2010 (JP) ..... 2010-073389

(51) Int. Cl.
*G09G 5/02* (2006.01)
*G09G 3/34* (2006.01)

(52) U.S. Cl.
CPC ..... *G09G 3/3426* (2013.01); *G09G 2320/0646* (2013.01); *G09G 2320/0686* (2013.01); *G09G 2330/021* (2013.01); *G09G 2340/0407* (2013.01); *G09G 2340/0464* (2013.01); *G09G 2360/16* (2013.01)
USPC ..... 345/694

(58) Field of Classification Search
CPC ... G09G 3/3426; G09G 10/0237; G09G 5/32; G09G 5/30; G09G 5/373; G09G 5/38
USPC ..... 345/694
See application file for complete search history.

(56) References Cited

U.S. PATENT DOCUMENTS

| | | | | |
|---|---|---|---|---|
| 2005/0184952 | A1 | 8/2005 | Konno et al. | |
| 2006/0109234 | A1 * | 5/2006 | Hong et al. | 345/102 |
| 2006/0214904 | A1 | 9/2006 | Kimura et al. | |
| 2006/0227125 | A1 | 10/2006 | Wong et al. | |
| 2008/0079671 | A1 * | 4/2008 | Yamazaki et al. | 345/82 |

(Continued)

FOREIGN PATENT DOCUMENTS

| | | | |
|---|---|---|---|
| JP | 2001-021863 | A | 1/2001 |
| JP | 2004-184937 | A | 7/2004 |

(Continued)

OTHER PUBLICATIONS

Official Communication issued in International Patent Application No. PCT/JP2010/070664, mailed on Feb. 22, 2011.

*Primary Examiner* — Nitin Patel
*Assistant Examiner* — Sejoon Ahn
(74) *Attorney, Agent, or Firm* — Keating & Bennett, LLP

(57) ABSTRACT

An image display device (2) controls a backlight luminance on the basis of a plurality of areas corresponding to LEDs, which are defined by dividing an input image. To cause sides of each subscreen to coincide with sides of its corresponding area, a subscreen control section (10) included in the image display device (2) changes positions and sizes of subscreen input images $Dv_1$ to $Dv_3$ included in a multiscreen input image Dv, the positions and the sizes being determined by subscreen setting data Ds, which is setting information. As a result, the number of areas corresponding to each subscreen is reduced, so that the number of LEDs to be lit up is reduced without causing display failures, thereby achieving low power consumption.

9 Claims, 11 Drawing Sheets

(56) References Cited

U.S. PATENT DOCUMENTS

| | | | | |
|---|---|---|---|---|
| 2010/0302219 | A1 | 12/2010 | Kitashou | |
| 2011/0115826 | A1 * | 5/2011 | Fujiwara | 345/690 |

FOREIGN PATENT DOCUMENTS

| | | | |
|---|---|---|---|
| JP | 2005-258403 | A | 9/2005 |
| JP | 2006-091147 | A | 4/2006 |
| JP | 2006-251465 | A | 9/2006 |
| JP | 2007-034251 | A | 2/2007 |
| JP | 2008-039795 | A | 2/2008 |
| JP | 2009-157045 | A | 7/2009 |
| JP | 2010-277536 | A | 12/2010 |
| WO | 2009/054223 | A1 | 4/2009 |
| WO | WO 2009054223 | A1 * | 4/2009 |

* cited by examiner

155

| | | | | |
|---|---|---|---|---|
| 0 | 0 | 10 | 0 | 0 |
| 0 | 30 | 50 | 30 | 0 |
| 10 | 50 | 100 | 50 | 10 |
| 0 | 30 | 50 | 30 | 0 |
| 0 | 0 | 10 | 0 | 0 |

IMAGE-DISPLAY DEVICE AND CONTROL METHOD OF SAME

TECHNICAL FIELD

The present invention relates to image display devices, particularly to an image display device with the function of controlling the luminance of a backlight (backlight dimming function).

BACKGROUND ART

Image display devices provided with backlights, such as liquid crystal display devices, can control the luminances of the backlights on the basis of input images, thereby suppressing power consumption by the backlights and improving the quality of display images. In particular, by dividing a screen into a plurality of areas and controlling the luminances of backlight sources corresponding to the areas on the basis of portions of an input image within the areas, it is rendered possible to achieve lower power consumption and higher image quality. Hereinafter, such a method for driving a display panel while controlling the luminances of backlight sources on the basis of input image portions within areas will be referred to as "area-active drive".

Image display devices of area-active drive type use, for example, LEDs (light emitting diodes) of three colors, i.e., R, G and B, and LEDs of white as backlight sources. Luminances (luminances upon emission) of LEDs corresponding to areas are obtained on the basis of, for example, maximum or mean pixel luminances within the areas, and provided to a backlight driver circuit as LED data. In addition, display data (in the case of a liquid crystal display device, data for controlling the light transmittance of the liquid crystal) is generated on the basis of the LED data and an input image, and the display data is provided to a display panel driver circuit. Note that in the case of a liquid crystal display device, the luminance of each pixel on the screen is the product of the luminance of light from the backlight and the light transmittance based on the display data. The display data is generated on the basis of an input image and a maximum luminance (hereinafter, referred to as a "display luminance") with which display is provided in areas by all LEDs emitting light.

The display panel driver circuit is driven on the basis of the display data thus generated, and the backlight driver circuit is driven on the basis of the LED data, so that image display based on the input image is provided.

Note that in relevance to this invention, the following prior art documents are known. Japanese Laid-Open Patent Publication Nos. 2004-184937, 2005-258403, and 2007-34251 disclose inventions of display devices in which the screen is divided into a plurality of areas and the emission luminance of a backlight provided for each area is controlled to achieve a reduction in power consumption. In particular, in the liquid crystal display device disclosed in Japanese Laid-Open Patent Publication No. 2004-184937, backlight sources in non-display regions are automatically stopped from being lit up, thereby achieving a reduction in power consumption.

CITATION LIST

Patent Document

Patent Document 1: Japanese Laid-Open Patent Publication No. 2004-184937

Patent Document 2: Japanese Laid-Open Patent Publication No. 2005-258403

Patent Document 3: Japanese Laid-Open Patent Publication No. 2007-34251

SUMMARY OF THE INVENTION

Problems to be Solved by the Invention

In conventional area-active drive image display devices, however, when partial display is provided (e.g., when Full-HD image display is provided by a high-resolution display device called "4K2K"), LEDs are generally lit up in areas equivalent to a wider range than a display area, unless conditions, such as size and shape, of the display area are (incidentally) in agreement. This is because LEDs in any area that includes only a small portion of the display area in which partial display is provided are lit up without fail.

However, in the case where a number of areas include only small portions of the display area, consequently, a number of LEDs illuminate small regions. As a result, power is unnecessarily consumed. Note that even if only small portions are included, LEDs corresponding to such areas cannot be left unlit. Assuming that they are left unlit, display failures might occur, including, for example, no display being provided or at least tone display not being properly provided.

Therefore, an objective of the present invention is to achieve low power consumption in an area-active drive image display device by reducing the number of LEDs to be lit up upon partial display while preventing display failures.

Solution to the Problems

A first aspect of the present invention is directed to an image display device with a function of controlling a backlight luminance and a function of displaying one or more rectangular subscreens indicating one or more input images, in a display screen, comprising:

a display panel including a plurality of display elements for controlling light transmittances, the display panel having the display screen;

a backlight including a plurality of light sources;

a screen control section for determining for each of the one or more subscreens either a position in which to arrange the subscreen in the display screen or a size of the subscreen, or both;

a screen generation section for generating a combined input image in which the one or more input images are arranged in either or both of the position and the size determined by the screen control section, an emission luminance calculation section for setting a plurality of areas corresponding to the light sources within the combined input image, and obtaining emission luminance data on the basis of the combined input image for each of the set areas, the emission luminance data indicating luminances upon emission of the light sources corresponding to the area;

a display data calculation section for obtaining display data for controlling the light transmittances of the display elements, on the basis of the combined input image and the emission luminance data obtained by the emission luminance calculation section;

a panel driver circuit for outputting signals for controlling the light transmittances of the display elements to the display panel, on the basis of the display data; and a backlight driver circuit for outputting signals for controlling the luminances of the light sources to the backlight, on the basis of the emission luminance data, wherein, the screen control section sets either the position in which to arrange the subscreen or the size of the subscreen, or both, such that a boundary of the subscreen coincides with a boundary of any one of the areas.

In a second aspect of the present invention, based on the first aspect of the invention, the screen control section sets a predetermined or externally received arrangement position for the subscreen on the basis of a result of performing either or both of computation for a movement of a shorter moving distance in a horizontal moving direction within the display screen or computation for a movement of a shorter moving distance in a vertical moving direction within the display screen, so as to cause the boundary of the subscreen to coincide with the boundary of the area.

In a third aspect of the present invention, based on the second aspect of the invention, without changing a position of the boundary of the subscreen caused to coincide with the boundary of the area by moving the arrangement position of the subscreen, the screen control section sets the size of the subscreen on the basis of a result of performing computation for reducing the size such that an opposite boundary of the subscreen coincides with a corresponding opposite boundary of the area.

In a fourth aspect of the present invention, based on the first aspect of the invention, the screen control section sets a predetermined or externally received size of the subscreen on the basis of a result of performing either or both of computation for reducing a horizontal dimension of the display screen in a direction to change the size to a smaller degree or computation for reducing a vertical dimension of the display screen in a direction to change the size to a smaller degree, so as to cause the boundary of the subscreen to coincide with the boundary of the area.

In a fifth aspect of the present invention, based on the fourth aspect of the invention, when the size of the subscreen is reduced both in the horizontal direction and the vertical direction, the screen control section computes rates of reduction in the horizontal direction and the vertical direction, and sets the size of the subscreen such that the size is reduced both in the horizontal direction and the vertical direction at the rate of reduction for a smaller change in size.

In a sixth aspect of the present invention, based on the fourth aspect of the invention, when the size of the subscreen is reduced both in the horizontal direction and the vertical direction, the screen control section computes rates of reduction in the horizontal direction and the vertical direction, and sets the size of the subscreen such that the size is reduced both in the horizontal direction and the vertical direction at the rate of reduction for a direction perpendicular to a side of the subscreen that has a greater ratio of length to a corresponding side of the area.

A seventh aspect of the present invention is directed to a method for controlling an image display device having a function of controlling a backlight luminance and a function of displaying one or more rectangular subscreens indicating one or more input images, in a display screen, the image display device being provided with a display panel including a plurality of display elements for controlling light transmittances and having the display screen, and a backlight including a plurality of light sources, the method comprising:

a screen control step of determining for each of the one or more subscreens either a position in which to arrange the subscreen in the display screen or a size of the subscreen, or both;

a screen generation step of generating a combined input image in which the one or more input images are arranged in either or both of the position and the size determined in the screen control step, an emission luminance calculation step of setting a plurality of areas corresponding to the light sources within the combined input image, and obtaining emission luminance data on the basis of the combined input image for each of the set areas, the emission luminance data indicating luminances upon emission of the light sources corresponding to the area;

a display data calculation step of obtaining display data for controlling the light transmittances of the display elements, on the basis of the combined input image and the emission luminance data obtained in the emission luminance calculation step;

a panel drive step of outputting signals for controlling the light transmittances of the display elements to the display panel, on the basis of the display data; and a backlight drive step of outputting signals for controlling the luminances of the light sources to the backlight, on the basis of the emission luminance data, wherein, in the screen control step, either the position in which to arrange the subscreen or the size of the subscreen, or both, are set such that a boundary of the subscreen coincides with a boundary of any one of the areas.

Effect of the Invention

According to the first aspect of the present invention, since the screen control section sets either the position in which to arrange the subscreen or the size of the subscreen, or both, such that a boundary of the subscreen coincides with a boundary of an area, the number of light sources in the backlight, which are typically lit up in part to display the subscreen smaller than the display screen, can be reduced, thereby achieving low power consumption without causing display failures.

According to the second aspect of the present invention, since the screen control section sets the arrangement position for the subscreen on the basis of a result of performing the computation for a movement in the moving direction for a shorter moving distance, the position of the subscreen is moved to the smallest possible degree. Thus, a reduction in display quality, which might occur due to the position of the subscreen being significantly moved from its original display position, can be prevented.

According to the third aspect of the present invention, without changing the position of the boundary of the subscreen caused to coincide with the boundary of the area by moving the arrangement position of the screen, the screen control section causes the opposite boundary of the subscreen to coincide with the corresponding opposite boundary of the area. Thus, the number of light sources in the backlight, which cannot be reduced simply by moving the subscreen, can be further reduced.

According to the fourth aspect of the present invention, since the screen control section sets the size of the subscreen on the basis of a result of performing the computation for size reduction in the direction to change the size of the subscreen to a smaller degree, a reduction in display quality, which might occur due to the size of the subscreen being greatly changed from the original size, can be prevented.

According to the fifth aspect of the present invention, since the screen control section sets the size of the subscreen such that the size is reduced both in the horizontal direction and the vertical direction at the rate of reduction for a smaller change in size, the aspect ratio of the subscreen does not change, keeping the screen undeformed and making it possible to prevent a reduction in display quality, which might occur due to the size being greatly changed from the original size.

According to the sixth aspect of the present invention, since the screen control section sets the size of the subscreen such that the size is reduced both in the horizontal direction and the vertical direction at the rate of reduction for a direction perpendicular to a side of the subscreen that has a greater ratio of length to a corresponding side of the area, the side that overlaps more areas is moved so that, typically, the number of light sources to be lit up in the backlight can be reduced, thereby achieving low power consumption without causing display failures.

According to the seventh aspect of the present invention, the same effect as that achieved by the first aspect of the present invention can be achieved by an image display device control method.

MODES FOR CARRYING OUT THE INVENTION

Hereinafter, an embodiment of the present invention will be described with reference to the accompanying drawings.

<1. Overall Configuration and Overview of the Operation>

Figure 1:
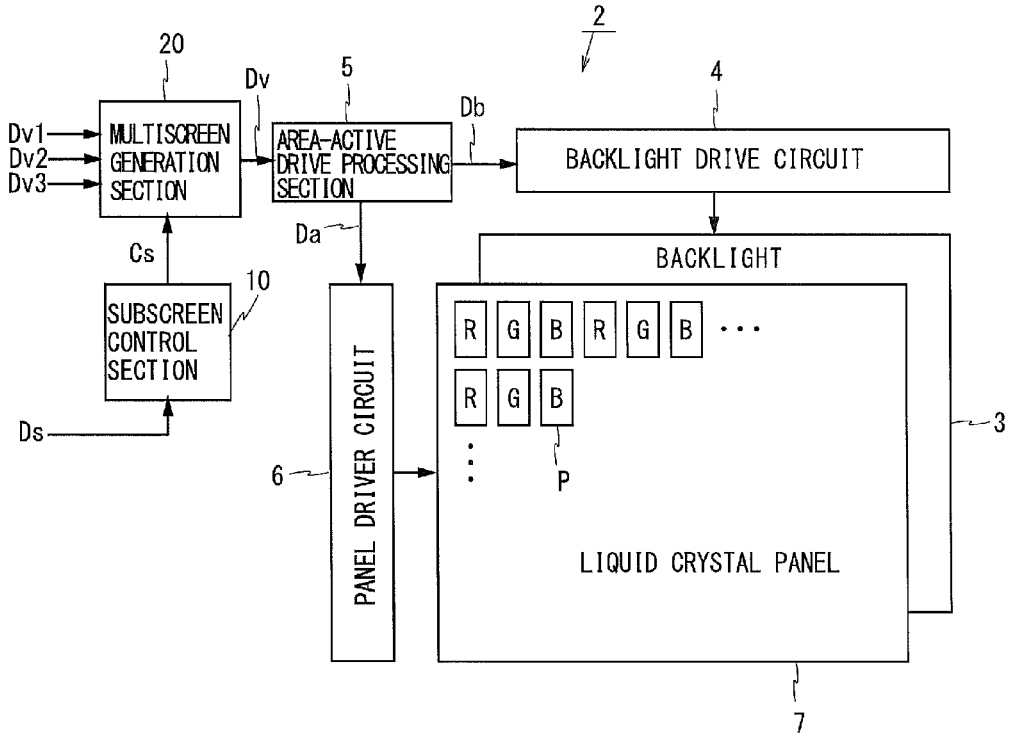
FIG. 1 is a block diagram illustrating the configuration of an image display device according to an embodiment of the present invention.

FIG. 1 is a block diagram illustrating the configuration of a liquid crystal display device 2, which is an image display device according to an embodiment of the present invention. The liquid crystal display device 2 shown in FIG. 1 includes a backlight 3, a backlight driver circuit 4, a panel driver circuit 6, a liquid crystal panel 7, an area-active drive processing section 5, a subscreen control section 10, and a multiscreen generation section 20.

The liquid crystal display device 2 performs area-active drive in which the liquid crystal panel 7 is driven in accordance with luminances of backlight sources corresponding to a plurality of areas defined by dividing the screen, the luminances being controlled on the basis of portions of a multiscreen input image Dv (provided to the area-active drive processing section 5) within the areas. Such multiscreen display is employed, for example, when the liquid crystal display device 2 is a high-resolution display device called "4K2K" and displays a Full-HD image as an input image.

Here, for convenience of explanation, the areas are described as being set by simply dividing the display screen, but, as will be described later, the areas may be set so as to include portions overlapping their surrounding areas, or positions of boundaries among the areas may change (in accordance with, for example, input images and luminance calculation processing).

The liquid crystal display device 2 receives signals indicating first to third subscreen input images $Dv_1$ to $Dv_3$, each of which includes an R image, a G image, and a B image (hereinafter, the signals will also be denoted by $Dv_1$ to $Dv_3$), from outside the device. Note that the number of subscreen input images derived from outside the device (or generated inside the device) may be one or more, and therefore the following description focuses on the first subscreen input image $Dv_1$, which is smaller than the entire display screen, and one subscreen within the display screen, which is a screen on which to display that image. Note that the subscreen herein refers to a rectangular image display region smaller than the display screen (or the rectangular image itself), and does not necessarily have the relationship of priority with respect to a main screen or suchlike nor any specific display mode as a screen.

Each of the R, G, and B images included in the subscreen input images $Dv_1$ to $Dv_3$ has luminances for (m×n) pixels or less. Here, m and n are integers of 2 or more, i and j to be described below are integers of 1 or more, but at least one of i and j is an integer of 2 or more.

The subscreen control section 10 receives subscreen setting data Ds, which is setting information such as the size and the display position of each subscreen, and corrects (where necessary) the position and the size indicated by the subscreen setting data Ds, such that the number of backlight sources (the number of areas) to be lit up is reduced. Setting data including the corrected position and size is outputted as subscreen control information Cs. The correction operation of the subscreen control section 10 characterizes the present invention and therefore will be described in detail later.

Note that the subscreen setting data Ds may be unalterably determined at the time of production and prestored in (unillustrated nonvolatile memory included in) the subscreen control section 10 or may be appropriately determined during operation of the device on the basis of an operation input from an unillustrated remote controller or suchlike operated by the user.

The multiscreen generation section 20 receives the subscreen control information Cs, and generates a multiscreen input image Dv indicating a multiscreen for combining and displaying (providing multidisplay of) the subscreen input images $Dv_1$ to $Dv_3$ simultaneously on the display screen in the positions and the sizes indicated by the subscreen control information Cs.

The description herein is given on the premise that any portion of the multiscreen input image Dv that is not occupied by the subscreen input images $Dv_1$ to $Dv_3$ is displayed as black. Accordingly, backlight sources in any area corresponding to such a black display portion of the multiscreen input image Dv are not lit up. However, in place of the black display, (background) display may be provided using a darker color than the subscreen input images $Dv_1$ to $Dv_3$ (or using a predetermined dark color). Even in such a case, the backlight sources are merely lit up with low luminance, so that the effect of power consumption reduction by a correction operation to be described later can be achieved.

Note that the relationship of priority of display among the subscreen input images $Dv_1$ to $Dv_3$ may be determined in advance or on the basis of an operation input as mentioned above. Moreover, the subscreen input images $Dv_1$ to $Dv_3$ may be controlled to be positioned without overlapping one another, in accordance with the relationship of priority among them, or the mode of image display may be controlled such that an image with a higher priority is not hidden. In addition, gamma values, luminance values, etc., which are similarly determined in advance or on the basis of an operation input, maybe used at the time of display. Operations for gamma corrections based on the gamma values and display luminance settings are well-known, and therefore any descriptions thereof will be omitted.

The area-active drive processing section 5 obtains display data (hereinafter, referred to as liquid crystal data Da) for use in driving the liquid crystal panel 7 and backlight control data (hereinafter, referred to as LED data Db) for use in driving the backlight 3, on the basis of the multiscreen input image Dv, which is a combined image for multidisplay, generated by the multiscreen generation section 20 (details will be described later).

The liquid crystal panel 7 includes (m×n×3) display elements P. The display elements P are arranged two-dimensionally as a whole, with each row including 3m of them in its direction (in FIG. 1, horizontally) and each column including n of them in its direction (in FIG. 1, vertically). The display elements P include R, G, and B display elements respectively transmitting red, green, and blue light therethrough. Each set of three display elements, i.e., R, G, and B, arranged in the row direction forms a single pixel.

The panel driver circuit 6 is a circuit for driving the liquid crystal panel 7. On the basis of the liquid crystal data Da outputted by the area-active drive processing section 5, the panel driver circuit 6 outputs signals (voltage signals) to the liquid crystal panel 7 to control light transmittances of the display elements P. The voltages outputted by the panel driver circuit 6 are written to pixel electrodes (not shown) in the display elements P, and the light transmittances of the display elements P change in accordance with the voltages written to the pixel electrodes.

Figure 2:
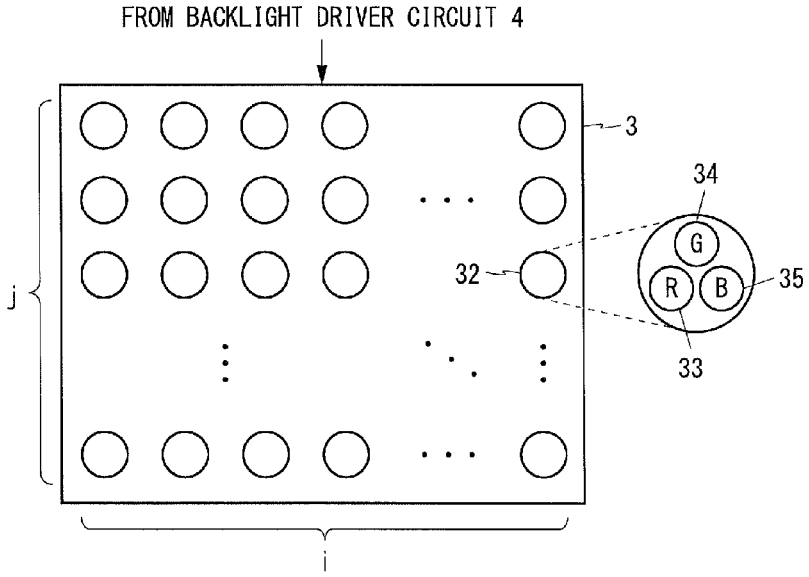
FIG. 2 is a diagram illustrating details of a backlight in the embodiment.

The backlight 3 is provided at the back side of the liquid crystal panel 7 to irradiate backlight to the back of the liquid crystal panel 7. FIG. 2 is a diagram illustrating details of the backlight 3. The backlight 3 includes (i×j) LED units 32, as shown in FIG. 2. The LED units 32 are arranged two-dimensionally as a whole, with each row including i of them in its direction and each column including j of them in its direction. Each of the LED units 32 includes one red LED 33, one green LED 34, and one blue LED 35. The three LEDs 33 to 35 included in each LED unit 32 emit light to be incident on a part of the back of the liquid crystal panel 7.

The backlight driver circuit 4 is a circuit for driving the backlight 3. On the basis of the LED data Db outputted by the area-active drive processing section 5, the backlight driver circuit 4 outputs signals (voltage signals or current signals) to the backlight 3 to control luminances of the LEDs 33 to 35. The luminances of the LEDs 33 to 35 are controlled independently of luminances of LEDs inside and outside their units.

The screen of the liquid crystal display device 2 is divided into (i×j) areas, each corresponding to one LED unit 32. Note that, in another configuration, each area may correspond to two or more LED units 32. Moreover, in the following descriptions, for convenience of explanation, the areas are set by simply dividing the screen, as described earlier.

For each of the (i×j) areas, the area-active drive processing section 5 obtains the luminance of the red LEDs 33 that correspond to that area on the basis of an R image within the area. Similarly, the luminance of the green LEDs 34 is determined on the basis of a G image within the area, and the luminance of the blue LEDs 35 is determined on the basis of a B image within the area. The area-active drive processing section 5 obtains luminances for all LEDs 33 to 35 included in the backlight 3, and outputs LED data Db representing the obtained LED luminances to the backlight driver circuit 4.

Furthermore, on the basis of the LED data Db, the area-active drive processing section 5 obtains backlight luminances for all display elements P included in the liquid crystal panel 7. In addition, on the basis of the multiscreen input image Dv and the backlight luminances, the area-active drive processing section 5 obtains light transmittances of all of the display elements P included in the liquid crystal panel 7, and outputs liquid crystal data Da representing the obtained light transmittances to the panel driver circuit 6. Note that the method for the area-active drive processing section 5 to obtain the backlight luminances will be described in detail later.

In the liquid crystal display device 2, the luminance of each R display element is the product of the luminance of red light emitted by the backlight 3 and the light transmittance of that R display element. Light emitted by one red LED 33 is incident on a plurality of areas around one corresponding area. Accordingly, the luminance of each R display element is the product of the total luminance of light emitted by a plurality of red LEDs 33 and the light transmittance of that R display element. Similarly, the luminance of each G display element is the product of the total luminance of light emitted by a plurality of green LEDs 34 and the light transmittance of that G display element, and the luminance of each B display element is the product of the total luminance of light emitted by a plurality of blue LEDs 35 and the light transmittance of that B display element.

In the liquid crystal display device 2 thus configured, the liquid crystal data Da and the LED data Db are appropriately obtained on the basis of the multiscreen input image Dv, the light transmittances of the display elements P are controlled on the basis of the liquid crystal data Da, and the luminances of the LEDs 33 to 35 are controlled on the basis of the LED data Db, so that the multiscreen input image Dv can be displayed on the liquid crystal panel 7. Described next is a correction operation by the subscreen control section 10 to reduce the number of backlight sources (the number of areas) to be lit up.

<2. Operation of the Subscreen Control Section>

<2.1 Overall Flow of the Correction Operation>

Figure 3:
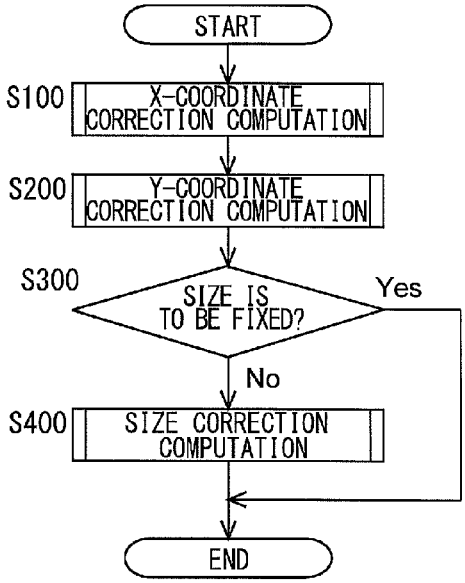
FIG. 3 is a flowchart illustrating the overall processing procedure of a correction operation by a subscreen control section in the embodiment.

FIG. 3 is a flowchart illustrating the overall processing procedure of the correction operation by the subscreen control section 10 in the present embodiment. In step S100 shown in FIG. 3, the subscreen control section 10 initially performs computation to (where necessary) correct the X-coordinate of a reference coordinate point of each subscreen (here, a vertex coordinate point at the upper left corner of the subscreen) in a position indicated by the subscreen setting data Ds, the position being determined in advance or otherwise set by the user. Note that in the following, a coordinate point refers to a pixel position in the display screen. Next, in step S200, the subscreen control section 10 performs computation to, where necessary, correct the Y-coordinate of the reference coordinate point.

The content of the computation for correcting the X- and Y-coordinates will be described in detail below, and such corrections are intended to appropriately move the subscreens to the right or the left (in the horizontal direction or the X-axis direction) within the display screen to decrease the number of backlight sources (the number of areas) to be lit up, thereby reducing power consumption. This will be described with reference to FIGS. 4 and 5.

Figure 4:
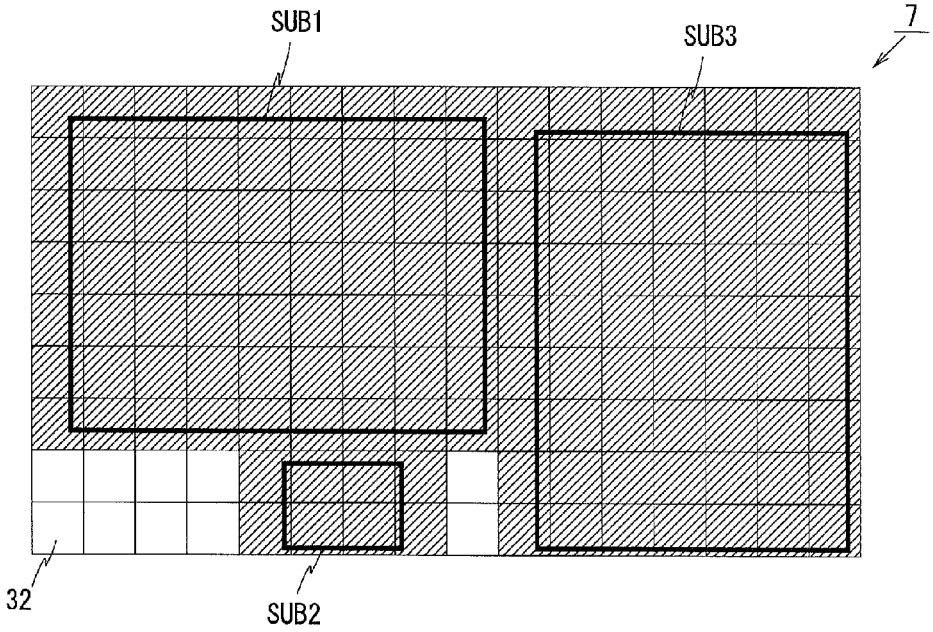
FIG. 4 is a diagram illustrating an exemplary display screen including subscreens where no correction is performed to move the subscreens in the embodiment.
Figure 5:
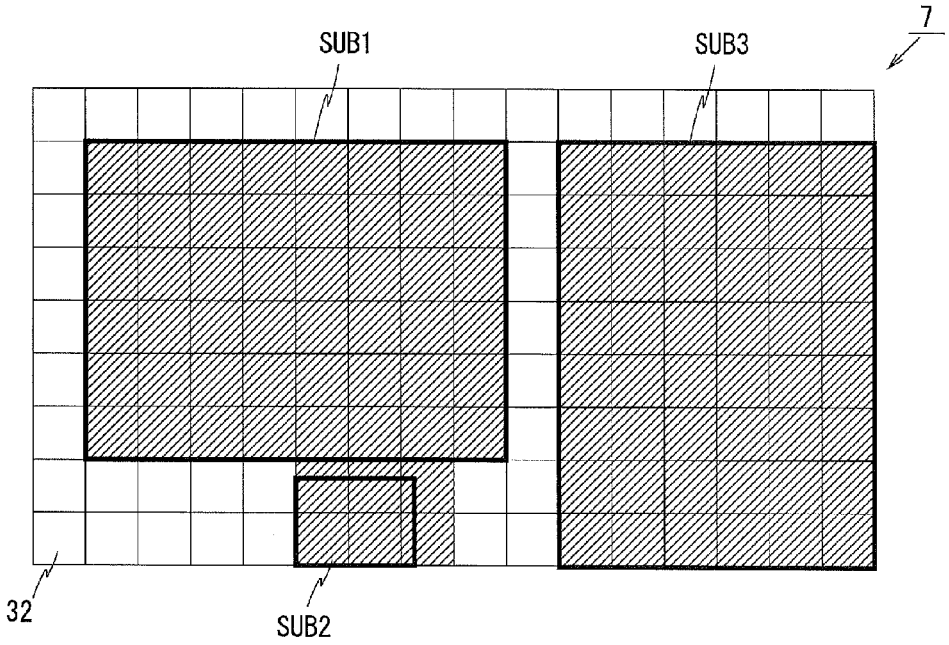
FIG. 5 is a diagram illustrating an exemplary display screen including subscreens subjected to corrections in the embodiment.

FIG. 4 is a diagram illustrating an exemplary display screen including subscreens where no correction is performed to move the subscreens. FIG. 5 is a diagram illustrating an exemplary display screen including subscreens subjected to corrections as mentioned above. In each of FIGS. 4 and 5, three subscreens $SUB_1$ to $SUB_3$ indicated by bold lines are displayed on the display screen of the liquid crystal panel 7, and correspond to the subscreen input images $Dv_1$ to $Dv_3$. Moreover, among 16 columns by 9 rows of LED units 32 indicated by fine lines, lit units are shown with hatching.

First of all, in FIG. 4, only ten LED units 32 remain unlit because any LED units 32 whose corresponding areas overlap any subscreen even to a slight degree are lit up. However, moving the subscreens to appropriate positions, as shown in FIG. 5, decreases the number of LED units 32 whose corresponding areas overlap any subscreen, so that the number of unlit LED units 32 increases to 42. In this manner, by appropriately moving the subscreens so as to be positioned in alignment with edges of areas, the number of unlit LED units can be increased, resulting in reduced power consumption. Moreover, the correction is carried out considering that the subscreens be moved to the smallest possible degree from their pre-correction positions in order not to significantly change the display screen as a result of the correction. Details will be described later.

Subsequently, in step S300, the subscreen control section 10 determines whether a size fixation flag to be described later, which indicates the size of each subscreen being fixed, is on or not, i.e., whether or not the number of backlight sources (the number of areas) to be lit up can be further reduced by the processing in steps S100 and S200. When the result of the determination is that the number to be lit up cannot be further reduced so that the size of each subscreen is fixed (Yes in step S300), the processing ends there, and on the other hand, when the number to be lit up can be further reduced so that the size of each subscreen is not fixed (No in step S300), the processing advances to step S400.

Figure 6:
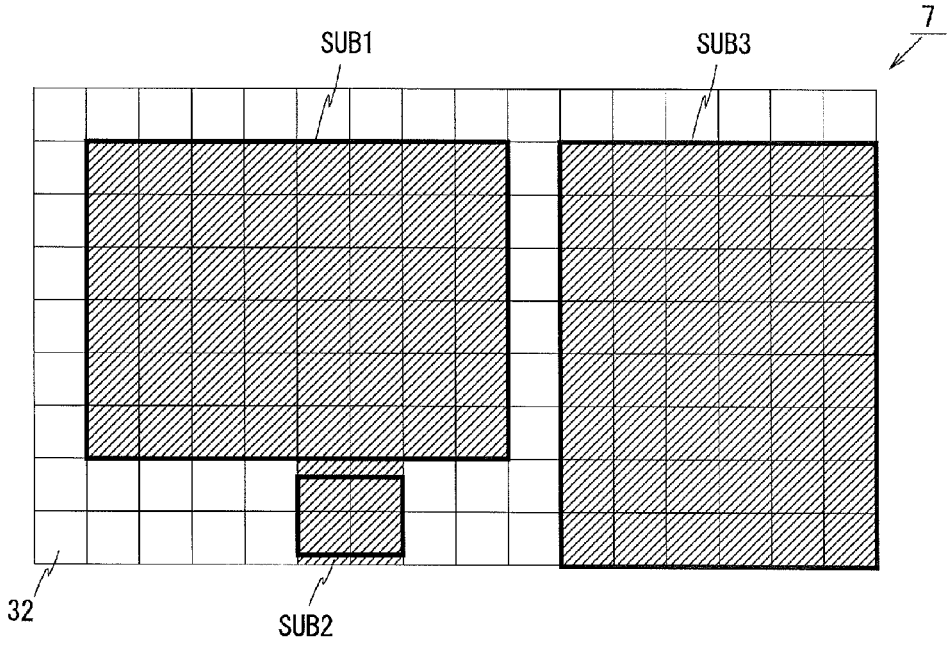
FIG. 6 is a diagram illustrating an exemplary display screen including subscreens subjected to corrections for reducing the size of the subscreens in the embodiment.

Next, in step S400, the subscreen control section 10 performs correction computation to appropriately reduce the size of each subscreen, for example, as shown in FIG. 6, without moving sides placed at the edges of areas by the processing in steps S100 and S200, away from the edges, thereby decreasing the number of backlight sources (the number of areas) to be lit up. Note that as in the case of the processing in steps S100 and S200, the correction computation is carried out considering that the subscreens be reduced to the smallest possible degree from their pre-correction sizes so as to keep the subscreens as large as possible in order not to significantly change the display screen as a result of the correction process for reducing the size of each subscreen in step S300. This also will be described in detail later.

FIG. 6 is a diagram illustrating an exemplary display screen including subscreens subjected to corrections for reducing the size of each of the subscreens. As can be appreciated from FIG. 6 in comparison with FIGS. 4 and 5, two subscreens $SUB_1$ and $SUB_3$ shown in FIG. 5 have all of their sides coinciding with edges of areas. Accordingly, their sizes are not required to be changed (the correction computation for size change shown in step S400 is not required to be performed). However, subscreen $SUB_2$ does not have all of its sides coinciding with edges of areas. Accordingly, it is preferable to change its size because the number to be lit up can be further reduced by doing so. Therefore, as shown in FIG. 6, only the size of subscreen $SUB_2$ is reduced (in the figure, to about 90 percent). This size reduction process causes subscreen $SUB_2$ to have all of its sides coinciding with edges of areas, so that two LED units 32 whose corresponding areas overlap subscreen $SUB_2$ in FIG. 5 are omitted, increasing the number of unlit LED units 32 to 44. Thus, a further reduction in power consumption can be achieved.

Hereinafter, the processing procedure for the aforementioned X-coordinate correction computation process in step S100 shown in FIG. 3 will be described in detail with reference to FIG. 7. Note that in the following, for convenience of explanation, correction computation is performed on one subscreen corresponding to the subscreen input image $Dv_1$, but in actuality, the same correction computation is performed on each displayed subscreen.

<2.2 X-Coordinate Correction Computation Process>

Figure 7:
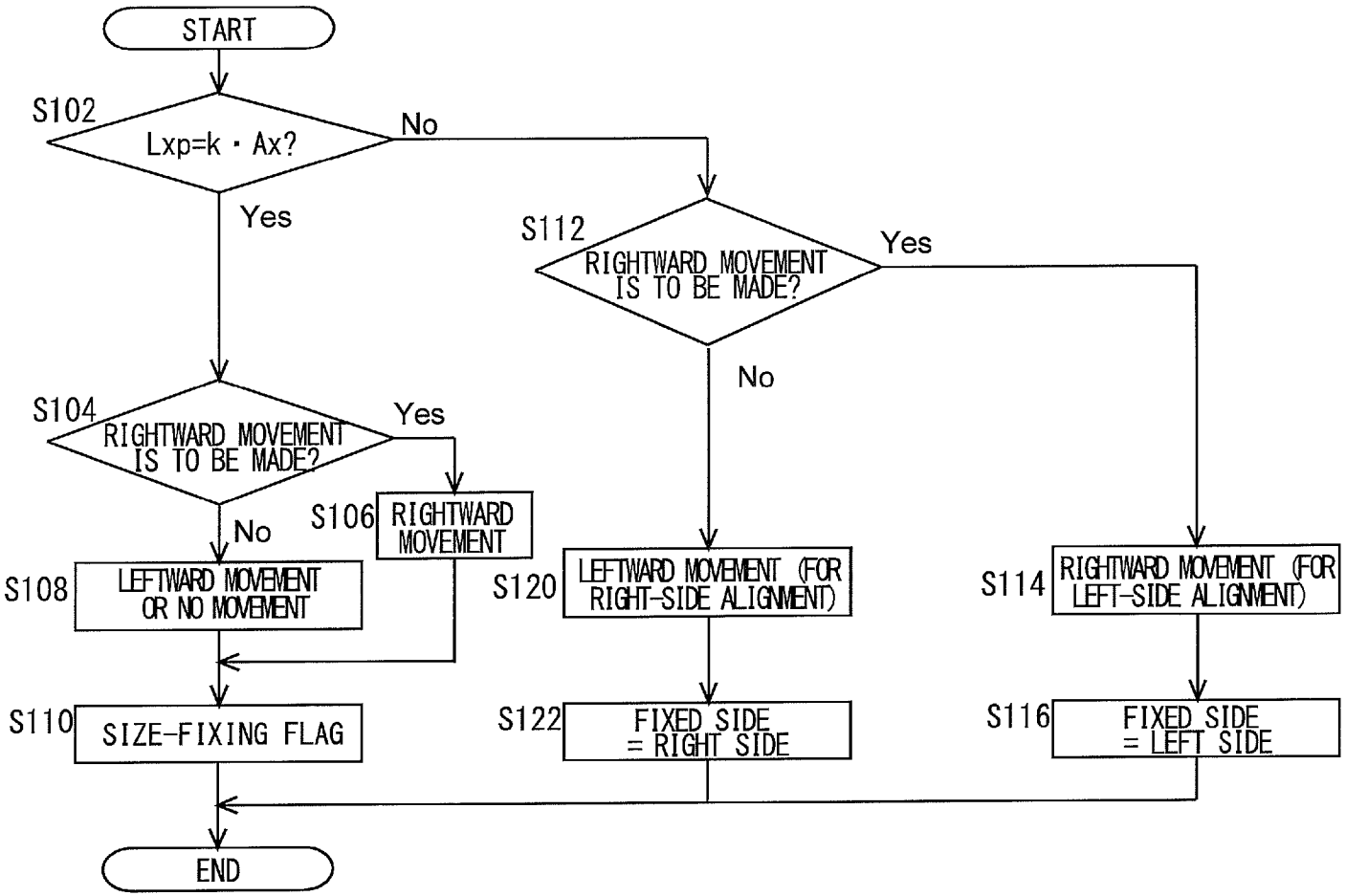
FIG. 7 is a flowchart illustrating the processing procedure for an X-coordinate correction computation process in the embodiment.

FIG. 7 is a flowchart illustrating the processing procedure for the X-coordinate correction computation process. In step S102 shown in FIG. 7, the subscreen control section 10 determines whether or not the X-axis direction dimension Lxp of a pre-correction subscreen corresponding to the subscreen input image $Dv_1$ is k times (where k is a natural number) the X-axis direction dimension Ax of an area. When the result of the determination indicates k times (Yes in step S102), the subscreen control section 10 proceeds to the processing of step S104, and when it does not indicate k times (No in step S102), the subscreen control section 10 proceeds to the processing of step S112.

Note that in the following, dimensions of subscreens and areas are represented by the number of pixels in the display screen, and coordinates are coordinates of pixels on the display screen. Moreover, as mentioned earlier, areas are set by dividing the display screen into the same size parts.

The determination of step S102 is made on the basis of the fact, when the size of the subscreen is exactly an integral multiple of the size of an area, by appropriately moving the subscreen, the position of the subscreen in the X-axis direction fits exactly the left and right sides of the area, i.e., the left and right sides of the subscreen fit exactly their corresponding sides of the area, so that the number of LED units 32 to be lit up can be reduced in the X-axis direction.

Next, in step S104, the subscreen control section 10 determines whether or not to move the subscreen to the right. Concretely, the subscreen control section 10 determines that the pre-correction subscreen corresponding to the subscreen input image $Dv_1$ should be moved to the right when equation (1) below is satisfied where the X-coordinate of the reference coordinate point (here, the coordinate point at the upper left corner) is Xp, and Xps is the minimum remainder (0 or more) of dividing Xp by the X-axis direction dimension Ax of the area p times (where p is a natural number).

$$Xps > Ax/2 \quad (1)$$

Here, when equation (1) above is satisfied, the reference coordinate point of the subscreen is positioned to the right of the center of the corresponding area, so that the moving distance can be smaller in the case of moving the subscreen to the right than to the left. Accordingly, when equation (1) is satisfied, the determination is that the movement to the right should be made.

In this manner, for example, when the movement to the right should be made because the rightward movement results in a shorter moving distance, the subscreen is moved to the right, thereby preventing a reduction in display quality (such as an unbalanced subscreen arrangement), which might occur as a result of moving the subscreen far away from its original display position.

When the result of the determination of step S104 is that the movement to the right should be made (Yes in step S104), the processing advances to step S106, and when the movement to the right should not be made (No in step S104), the processing advances to step S108.

Subsequently, in step S106, the subscreen control section 10 calculates X, which is the X-coordinate of a post-correction reference coordinate point for the subscreen, to move the subscreen to the right. Concretely, X is calculated by, for example, equation (2) below. Thereafter, the processing advances to step S110.

$$X=(p+1)\cdot Ax \tag{2}$$

Alternatively, in step S108, the subscreen control section 10 calculates X, the X-coordinate for the post-correction subscreen, to move the subscreen to the left or to not move the subscreen. Concretely, X is calculated by, for example, equation (3) below.

$$X=p\cdot Ax \tag{3}$$

Next, in step S110, the subscreen control section 10 sets a size fixation flag, which indicates that the number of backlight sources (the number of areas) to be lit up cannot be further reduced in the X-axis direction (or in the Y-axis direction). Note that correction computation has not yet been performed for the Y-axis direction, which is the vertical direction, but the reason for setting the size fixation flag is that changing the size of the subscreen might spoil the situation where the number of backlight sources (the number of areas) to be lit up in the X-axis direction is minimized by the aforementioned processing. However, when the rate of size change (here, the rate of reduction) of the subscreen may vary between the X-axis direction and the Y-axis direction (i.e., when the aspect ratio of the subscreen may be changed), two size fixation flags may come on, one for the X-axis, and the other for the Y-axis. Thereafter, serial processing within step S100 ends, and control advances to the aforementioned processing of step S200 shown in FIG. 3.

Note that in the case where the size fixation flag is on, as mentioned earlier, the size of the subscreen is determined to be fixed in step S300 (Yes in step S300), and the process for correcting the size of the subscreen in step S400 is omitted, so that the processing ends.

Furthermore, (in the case where Lxp=k·Ax is determined in step S102 to be not true) the subscreen control section 10 in step S112 determines whether or not to move the subscreen to the right.

Concretely, where the size Lxp of the subscreen is represented by equation (4) below using natural number b (where b is less than or equal to the X-axis direction dimension Ax of the area), the subscreen control section 10 determines whether or not equation (5) below is satisfied.

$$Lxp=k\cdot Ax+b \tag{4}$$

$$b/2\geq Ax-Xps \tag{5}$$

Here, as shown in equation (4) above, the size Lxp of the subscreen is greater than k times the size of the area by b. Accordingly, by moving the subscreen in an appropriate direction, either to the right or to the left, by an appropriate value less than or equal to half of the excess length b, the right or the left side of the subscreen can be moved the minimum distance so as to be positioned at either the right or the left side of the corresponding area. Accordingly, for example, when the subscreen is moved to the right, the moving distance from the (original) reference position of the subscreen to the right side of the area is (Ax−Xps), and therefore the movement to the right is appropriate if the moving distance is less than or equal to b/2. Therefore, when equation (5) above is satisfied, it can be said that moving the left side of the subscreen (i.e., the X-coordinate of the reference coordinate point) to the right so as to coincide with the left side of the corresponding area results in a shorter moving distance than does moving the right side of the subscreen to the left so as to coincide with the right side of the area. Thus, when equation (5) is satisfied, the determination that the rightward movement should be made is provided.

In this manner, for example, when the movement to the right should be made because the rightward movement results in a shorter moving distance, the subscreen is moved to the right, thereby preventing a reduction in display quality, which might occur as a result of moving the subscreen far away from its original display position, as mentioned earlier.

When the result of the determination of step S112 is that the movement to the right should be made (Yes in step S112), the processing advances to step S114, and when the movement to the left should be made (No in step S112), the processing advances to step S120.

Next, in step S114, the subscreen control section 10 calculates X, which is the X-coordinate of the post-correction reference coordinate point for the subscreen, to move the subscreen to the right. Concretely, X may be calculated by equation (2) mentioned above or may be calculated by adding the moving distance (Ax−Xps) to Xp, the pre-correction X-coordinate.

Subsequently, in step S116, the subscreen control section 10 memorizes the left side, which is the side caused to coincide with the left side of the area by the processing of step S114, as a fixed side. The reason for memorizing the fixed side is to cause no change in position in the process for correcting the size of the subscreen to be described later, and if the position of the fixed side is moved at the time of changing the size of the subscreen, it spoils the situation where the number of backlight sources (the number of areas) to be lit up is minimized in the X-axis direction by the aforementioned processing. Thereafter, the aforementioned X-coordinate correction computation process in step S100 shown in FIG. 4 ends, and subsequently, in step S200, the Y-coordinate correction computation process starts.

Furthermore, (in the case where the determination of step S112 is that the movement to the left should be made) the subscreen control section 10 in step S120 calculates the X-coordinate of the post-correction reference coordinate point for the subscreen, to move the subscreen to the left. Concretely, X is calculated by equation (3) mentioned above.

Subsequently, in step S122, the subscreen control section 10 memorizes the right side, which is the side caused to coincide with the right side of the area by the processing of step S120, as a fixed side. The reason for memorizing the fixed side is as mentioned earlier. Thereafter, the aforementioned X-coordinate correction computation process in step S100 shown in FIG. 4 ends, and subsequently, in step S200, the Y-coordinate correction computation process starts. Next, a detailed processing procedure for the Y-coordinate correction computation process in step S200 will be described in detail with reference to FIG. 8.

<2.3 Y-Coordinate Correction Computation Process>

Figure 8:
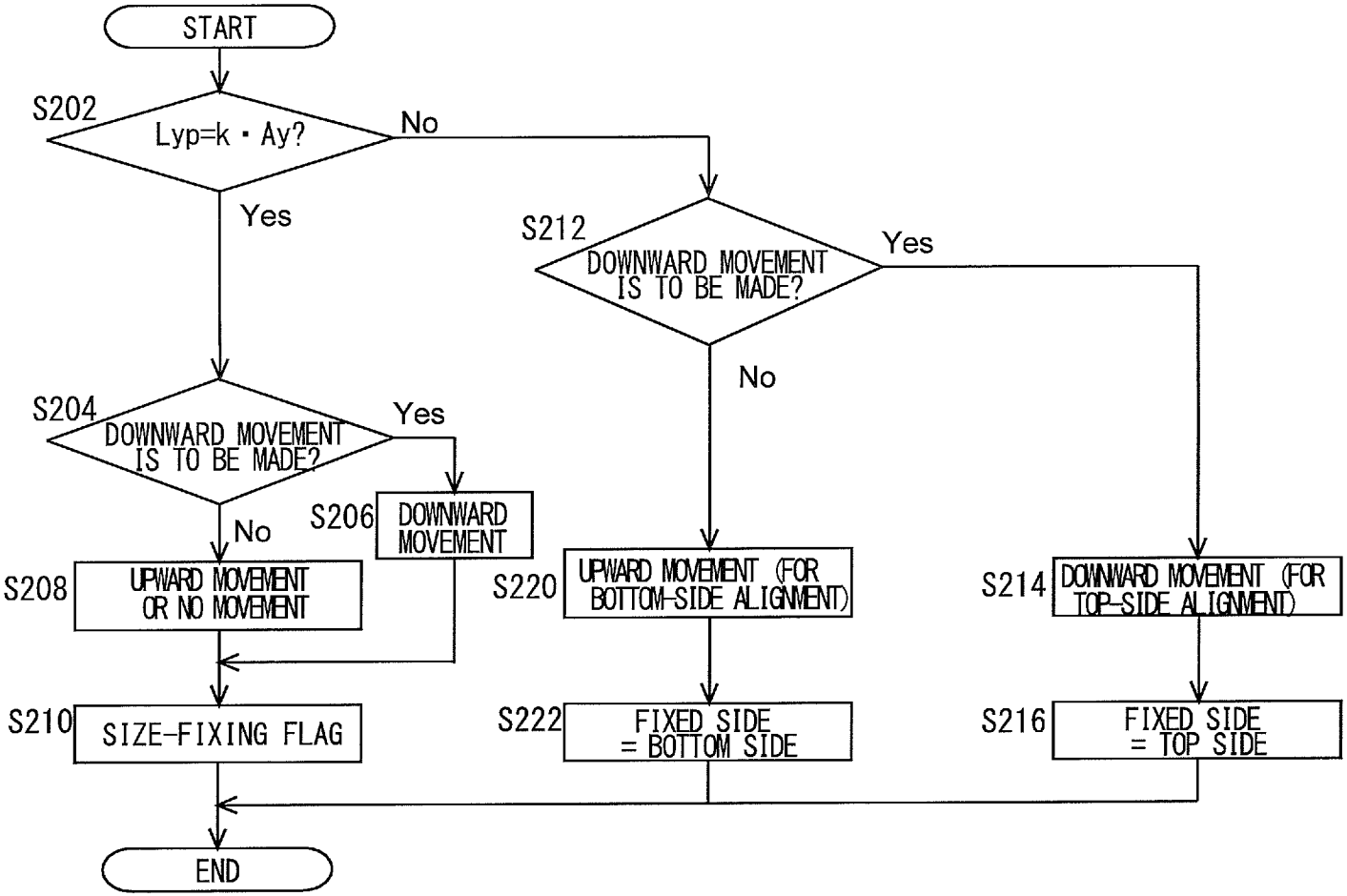
FIG. 8 is a flowchart illustrating the processing procedure for a Y-coordinate correction computation process in the embodiment.

FIG. 8 is a flowchart illustrating the processing procedure for the Y-coordinate correction computation process. The processing of steps S202 to S222 shown in FIG. 8 is almost the same as the processing of steps S102 to S122 shown in FIG. 7, as can be appreciated from comparison therebetween. Specifically, the content of the processing is the same except that the "X-coordinate" is replaced by the "Y-coordinate", "right" by "down" or "bottom", and "left" by "up" or "top". Therefore, any detailed description of the processing will be omitted.

Note that the X-coordinate correction computation process (S100) and the Y-coordinate correction computation process (S200) can be performed without being correlated to each other, and therefore the Y-coordinate correction computation process may be performed first or these computation processes may be performed at the same time. Alternatively, only one of them may be performed. The reason for this is that even only one of the processes can reduce the number of areas to be lit up in the X- or Y-axis direction. Next, a detailed processing procedure of the computation process for correcting the size of the subscreen in step S400 will be described in detail with reference to FIG. 9.

<2.4 Subscreen Size Correction Computation>

Figure 9:
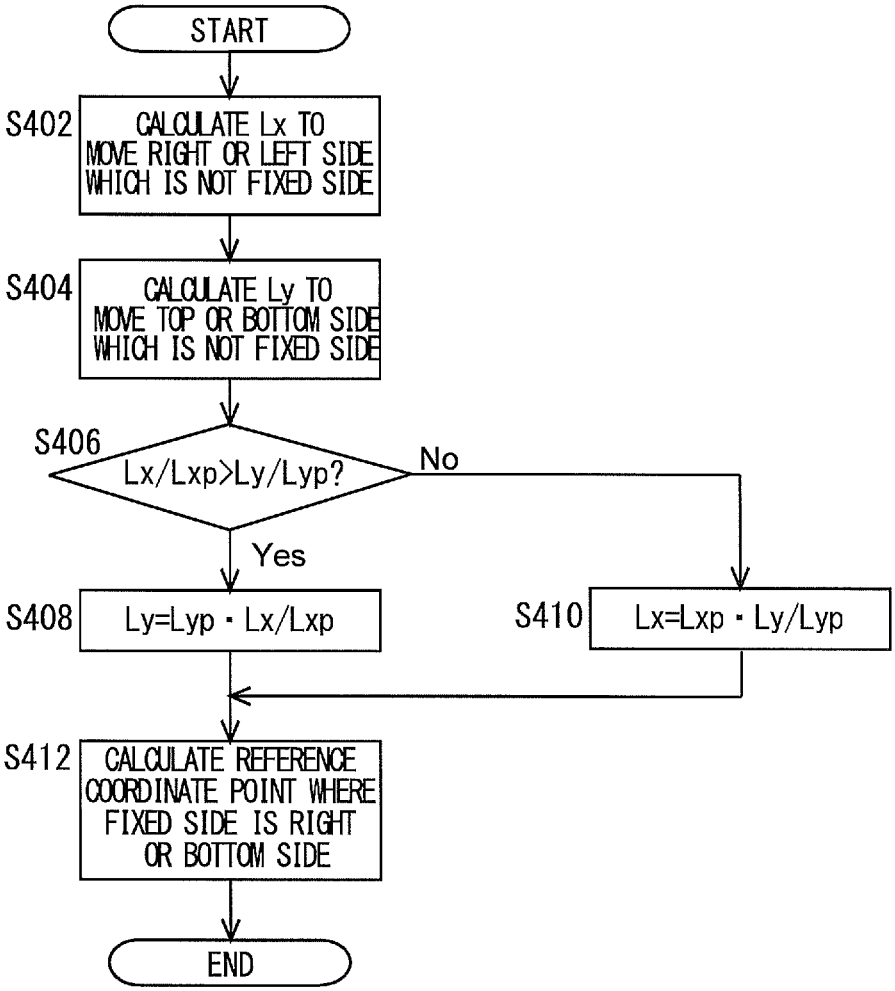
FIG. 9 is a flowchart illustrating the processing procedure for a subscreen size correction computation process in the embodiment.

FIG. 9 is a flowchart illustrating the processing procedure for a subscreen size correction computation process. In step S402 shown in FIG. 9, the subscreen control section 10 obtains the X-axis direction dimension Lx of the subscreen to position the right or left side, which is the side not fixed by the processing of step S116 or S122, so as to coincide with a corresponding side of an area as a result of size reduction.

Concretely, where the X-axis direction dimension Lxp of the pre-correction subscreen is represented by equation (4) mentioned above, the size Lx of the post-correction subscreen can be obtained by equation (6) below.

$$Lx=k\cdot Ax \tag{6}$$

Next, in step S404, the subscreen control section 10 obtains the Y-axis direction dimension Ly of the subscreen to position the top or bottom side, which is the side not fixed by the processing of step S216 or S222, so as to coincide with a corresponding side of the area as a result of size reduction. Ly can be calculated in a similar manner to Lx.

Subsequently, in step S406, the subscreen control section 10 determines whether or not Lx/Lxp is greater than Ly/Lyp. This determines whether or not the rate of reduction in the X-axis direction of the post-correction subscreen to the pre-correction subscreen is greater than the rate of reduction in the Y-axis direction (vertical direction) of the post-correction subscreen to the pre-correction subscreen, i.e., whether a greater rate of reduction in the X-axis direction (horizontal direction) results in a smaller size change in the X-axis direction than in the Y-axis direction. When the result of the determination is that the rate of reduction in the X-axis direction is greater (the change is smaller) (Yes in step S406), the subscreen control section 10 in step S408 further obtains the Y-axis direction dimension of the post-correction subscreen by equation (7) below in accordance with the rate of reduction in the X-axis direction. Thereafter, the processing advances to step S412.

$$Ly=Lyp\cdot Lx/Lxp \tag{7}$$

Furthermore, when the rate of reduction in the X-axis direction is smaller (the change is greater) (No in step S406), the subscreen control section 10 in step S410 further obtains the X-axis direction dimension of the post-correction subscreen by equation (8) below in accordance with the rate of reduction in the Y-axis direction. Thereafter, the processing advances to step S412.

$$Lx=Lxp\cdot Ly/Lyp \tag{8}$$

In this manner, when the size of the subscreen is changed, the dimension reduction processing is performed for both the X-axis direction and the Y-axis direction at the same rate of reduction as that of the smaller of the changes in the X-axis direction dimension and the Y-axis direction dimension. This maintains the aspect ratio of the subscreen, so that the subscreen can be displayed without deformation. Moreover, since the rate of reduction for the smaller change is used, display quality can be prevented from being reduced due to a significant change in size. In addition, the number of lit-up LEDs that cannot be turned off simply by moving the subscreen can be further reduced by moving an opposite side to a fixed side (in order to change the size of the subscreen) without moving the fixed side.

Next, in step S412, when the fixed side is the right side or the bottom side, the subscreen control section 10 calculates a reference coordinate point (at the upper left corner of the subscreen). Note that when the fixed side is the left side or the top side, the X-coordinate calculated by the processing of step S116 and the Y-coordinate calculated by the processing of step S216 can be used without modification, and therefore the reference coordinate is not required to be calculated.

Thereafter, all of the correction processing shown in FIG. 4 ends, and once the correction computation process is similarly performed on all subscreens, another correction computation process is not performed until the next time the position or the size of any input image is changed. Until then, the multiscreen generation section 20 stores subscreen control information Cs, including corrected positions and sizes, received from the subscreen control section 10, and determines the position and the size of a subscreen, including a new input image, in accordance with the stored values, thereby generating a multiscreen input image Dv. Next, the configuration and the operation of the area-active drive processing section will be described with reference to FIG. 10.

<3. Configuration and Operation of the Area-Active Drive Processing Section>

<3.1 Configuration of the Area-Active Drive Processing Section>

Figures 10, 11:
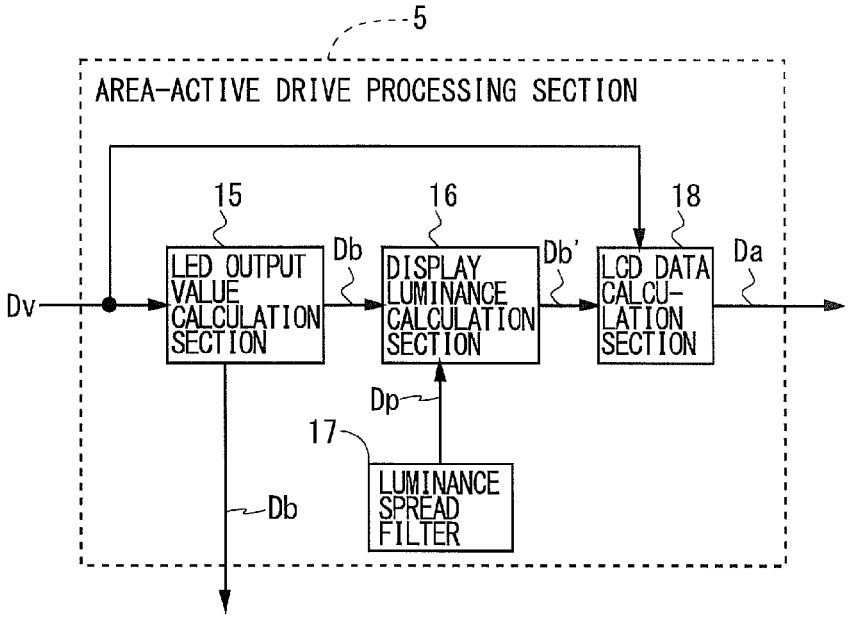
FIG. 10 is a block diagram illustrating a detailed configuration of an area-active drive processing section in the embodiment.
FIG. 11 is a diagram describing a luminance spread filter.

FIG. 10 is a block diagram illustrating a detailed configuration of the area-active drive processing section 5 in the present embodiment. The area-active drive processing section 5 includes an LED output value calculation section 15, a display luminance calculation section 16, and an LCD data calculation section 18 as components for performing predetermined processing, and also includes a luminance spread filter 17 as a component for storing predetermined data. Here, in the present embodiment, the LED output value calculation section 15 realizes an emission luminance calculation section, and the LCD data calculation section 18 realizes a display data calculation section. Note that the LED output value calculation section 15 also includes a component for storing predetermined data.

The LED output value calculation section 15 divides the multiscreen input image Dv into a plurality of areas (here), and obtains LED data (emission luminance data) Db indicating luminances upon emission of LEDs corresponding to the areas. Note that in the following, the value of a luminance upon emission of an LED will be referred to as an "LED output value". The luminance spread filter 17 has stored therein, for example, PSF data, which is data representing the spread of light as numerical values, as shown in FIG. 11, to calculate display luminance for each area.

The display luminance calculation section 16 calculates display luminance Db' for each area on the basis of the LED data Db obtained by the LED output value calculation section 15 and the PSF data Dp stored in the luminance spread filter 17.

On the basis of the multiscreen input image Dv and the display luminance Db' obtained for each area by the display luminance calculation section 16, the LCD data calculation section 18 obtains liquid crystal data Da representing light transmittances of all display elements P included in the liquid crystal panel 7.

<3.2 Processing Procedures by the Area-Active Drive Processing Section>

Figure 12:
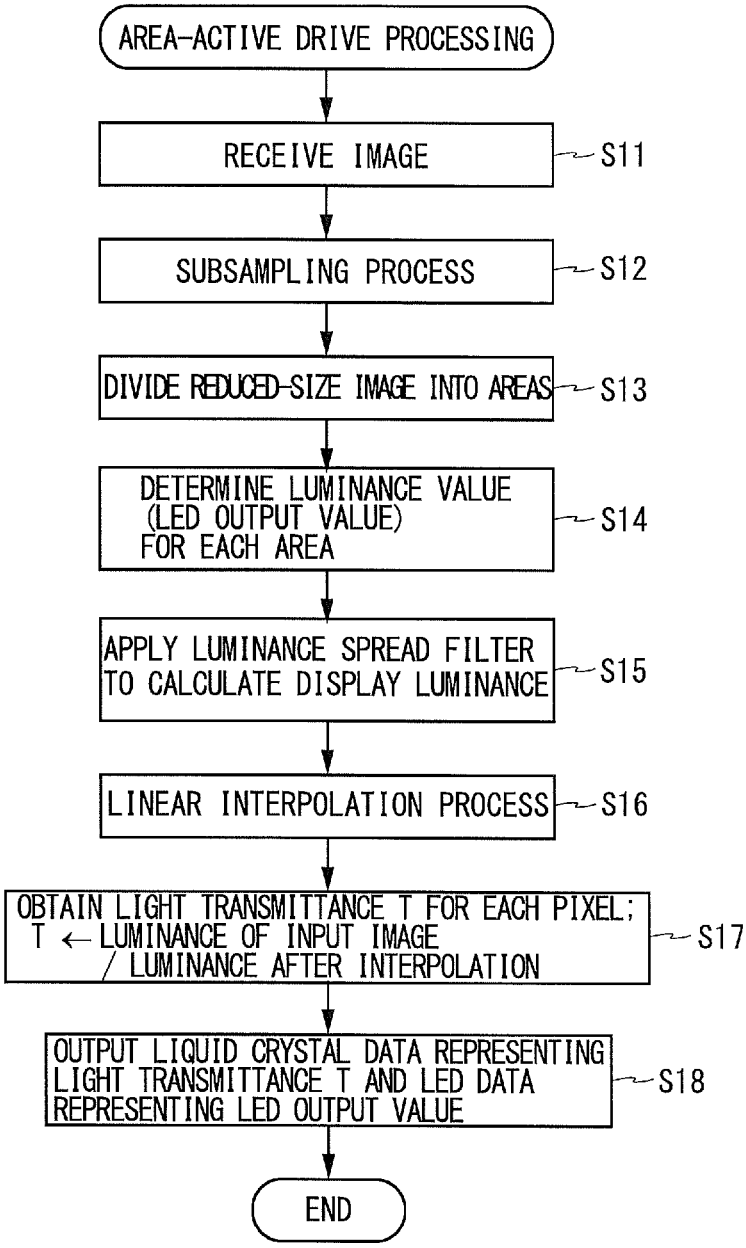
FIG. 12 is a flowchart illustrating a process by the area-active drive processing section in the embodiment.

FIG. 12 is a flowchart illustrating a process by the area-active drive processing section 5. The area-active drive processing section 5 receives an image for a color component (hereinafter, referred to as color component C) included in the multiscreen input image Dv (step S11). The received image for color component C includes luminances for (m×n) pixels.

Next, the area-active drive processing section 5 performs a subsampling process (averaging process) on the received image for color component C, and obtains a reduced-size image including luminances for $(s_i \times s_j)$ (where s is an integer of 2 or more) pixels (step S12). In step S12, the received image for color component C is reduced to $s_i/m$ in the horizontal direction and $s_j/n$ in the vertical direction. Then, the area-active drive processing section 5 divides the reduced-size image into (i×j) areas (step S13). Each area includes luminances for (s×s) pixels.

Next, the area-active drive processing section 5 obtains LED output values (luminance values upon emission of LEDs) for each of the (i×j) areas (step S14). Here, the positions and the sizes of the subscreen input images $Dv_1$ to $Dv_3$ included in the multiscreen input image Dv are set such that each subscreen has its sides overlapping their corresponding sides of an area, as described earlier, among the (i×j) areas, the number of areas in which no subscreen with an LED output value of 0 (in an unlit state) is displayed is larger than before the correction computation. Thus, power consumption can be reduced.

Note that conceivable examples of the method for determining the LED output values include a method that makes a determination on the basis of a maximum pixel luminance Ma within each area, a method that makes a determination on the basis of a mean pixel luminance Me within each area, and a method that makes a determination on the basis of a value obtained by calculating a weighted mean of the maximum pixel luminance Ma and the mean pixel luminance Me within each area. The processing from step S11 to step S14 is performed by the LED output value calculation section 15 within the area-active drive processing section 5.

Next, the area-active drive processing section 5 applies a luminance spread filter (point spread filter) 155 to the (i×j) LED output values obtained in step S14, thereby obtaining first backlight luminance data including $(t_i \times t_j)$ (where t is an integer of 2 or more) display luminances (step S15). In step S15, the (i×j) LED output values are increased to t-fold both in the horizontal and the vertical direction, thereby obtaining $(t_i \times t_j)$ display luminances. Note that the processing of step S15 is performed by the display luminance calculation section 16 within the area-active drive processing section 5.

Next, the area-active drive processing section 5 performs a linear interpolation process on the first backlight luminance data, thereby obtaining second backlight luminance data including (m×n) luminances (step S16). In step S16, the first backlight luminance data is increased to $(m/t_i)$-fold in the horizontal direction and $(n/t_j)$-fold in the vertical direction. The second backlight luminance data represents backlight luminances for color component C incident on (m×n) display elements P for color component C where (i×j) LEDs for color component C emit light with the luminances obtained in step S14.

Subsequently, the area-active drive processing section 5 divides the luminances of the (m×n) pixels included in the input image for color component C respectively by the (m×n) luminances included in the second backlight luminance data, thereby obtaining light transmittances T for the (m×n) display elements P for color component C (step S17).

Finally, for color component C, the area-active drive processing section 5 outputs the liquid crystal data Da, which represents the (m×n) light transmittances obtained in step S17, and LED data Db, which represents the (i×j) LED output values obtained in step S14 (step S18). At this time, the liquid crystal data Da and the LED data Db are converted to values within appropriate ranges in conformity with the specifications of the panel driver circuit 6 and the backlight driver circuit 4.

The area-active drive processing section 5 performs the process shown in FIG. 12 on an R image, a G image, and a B image, thereby obtaining liquid crystal data Da representing (m×n×3) transmittances and LED data Db representing (i×j×3) LED output values, on the basis of a multiscreen input image Dv including luminances for (m×n×3) pixels.

Figure 13:
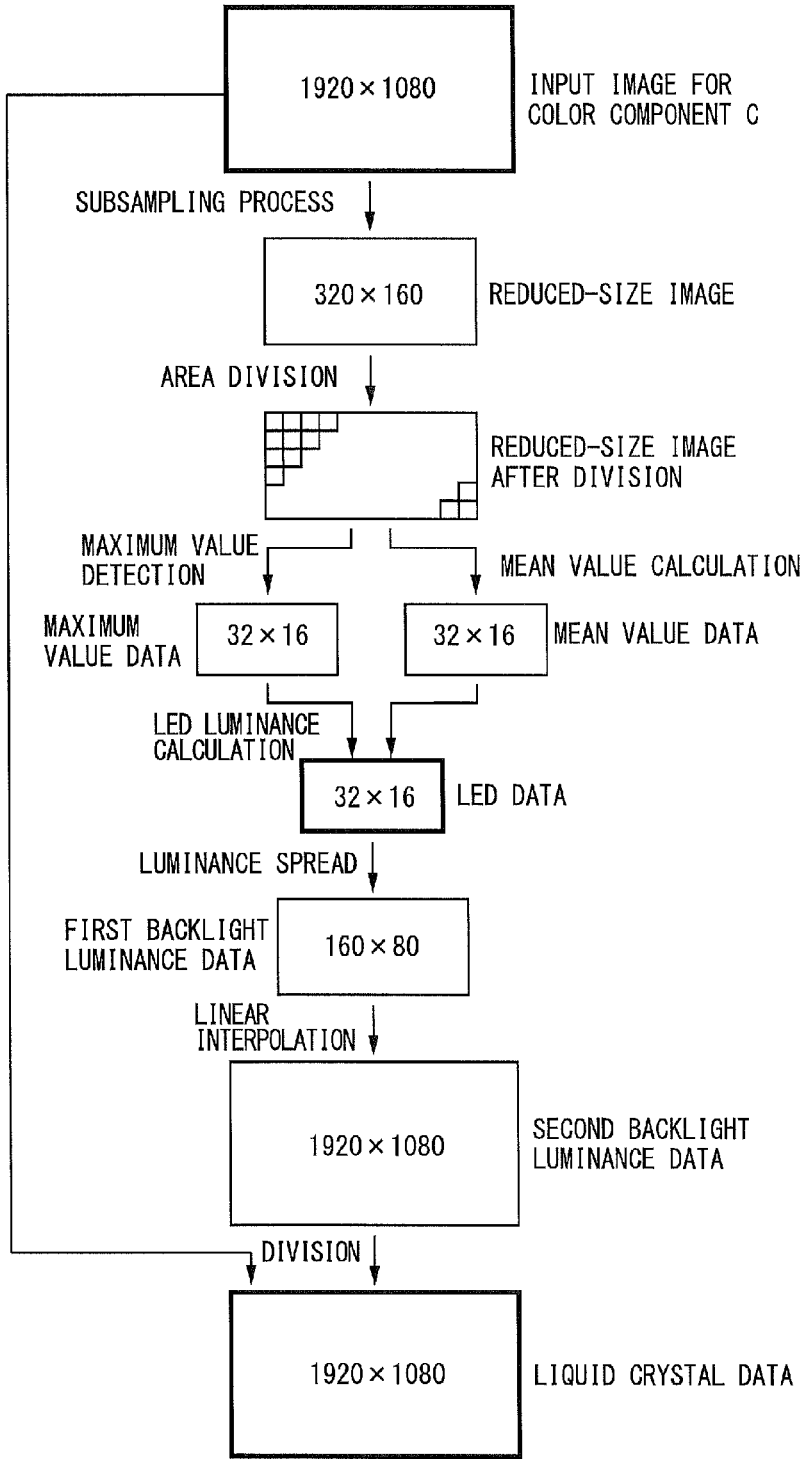
FIG. 13 is a diagram illustrating the course of action up to obtaining liquid crystal data and LED data in the embodiment.

FIG. 13 is a diagram illustrating the course of action up to obtaining liquid crystal data and LED data where m=1920, n=1080, i=32, j=16, s=10, and t=5. As shown in FIG. 13, a subsampling process is performed on an input image for color component C, which includes luminances of (1920×1080) pixels, thereby obtaining a reduced-size image including luminances of (320×160) pixels. The reduced-size image is divided into (32×16) areas (the size of each area is (10×10) pixels). For each area, the maximum value Ma and the mean value Me for the pixel luminances are calculated, thereby obtaining maximum value data including (32×16) maximum values and mean value data including (32×16) mean values. Then, on the basis of the maximum value data or the mean value data, alternatively, on the basis of weighted averaging of the maximum value data and the mean value data, LED data for color component C, which represents (32×16) LED luminances (LED output values), is obtained.

The luminance spread filter 17 is applied to the LED data for color component C, thereby obtaining first backlight luminance data including (160×80) display luminances. Then, a linear interpolation process is performed on the first backlight luminance data, thereby obtaining second backlight luminance data including (1920×1080) display luminances. Finally, liquid crystal data for color component C, which includes (1920×1080) light transmittances, is obtained by (comparative) computation such as division of the pixel luminances included in the input image for color component C by the display luminances included in the second backlight luminance data.

Note that in FIG. 12, for ease of explanation, the area-active drive processing section 5 sequentially performs the processing on images for color components, but the processing may be performed on the images for color components in a time-division manner. Furthermore, in FIG. 12, the area-active drive processing section 5 performs a subsampling process on an input image for noise removal and performs area-active drive on the basis of a reduced-size image, but the area active drive may be performed on the basis of the original input image.

<4. Effect>

In this manner, in the subscreen control section 10 of the present embodiment, the positions and the sizes of the subscreen input images $Dv_1$ to $Dv_3$ included in the multiscreen input image Dv are set such that each subscreen has its sides overlapping their corresponding sides of an area, so that the number of LEDs to be lit up upon partial display can be reduced, thereby achieving low power consumption without causing display failures. Note that even if portions of the display screen other than a multiscreen area are displayed with a dark tone as described earlier, low power consumption can be realized as well (since the number of light sources to be lit up with a predetermined luminance or more can be reduced although the total number to be lit up cannot be reduced).

Furthermore, when the position or the size of a subscreen is to be changed, such a change in position or size is made to the smallest possible degree, thereby preventing a reduction in display quality, which might occur due to the position of the subscreen being significantly moved from its original display position or the size being greatly changed, as described earlier.

<5. Variants>

<5.1 First Major Variant>

As described earlier in the embodiment, among steps S100 to S400 shown in FIG. 3, simply performing the processing of at least one of steps S100 and S200 can partially achieve the effect of reducing power consumption. Here, a description will be given with reference to FIG. 14, regarding the case where only the X-coordinate correction computation in step S100 is performed.

Figure 14:
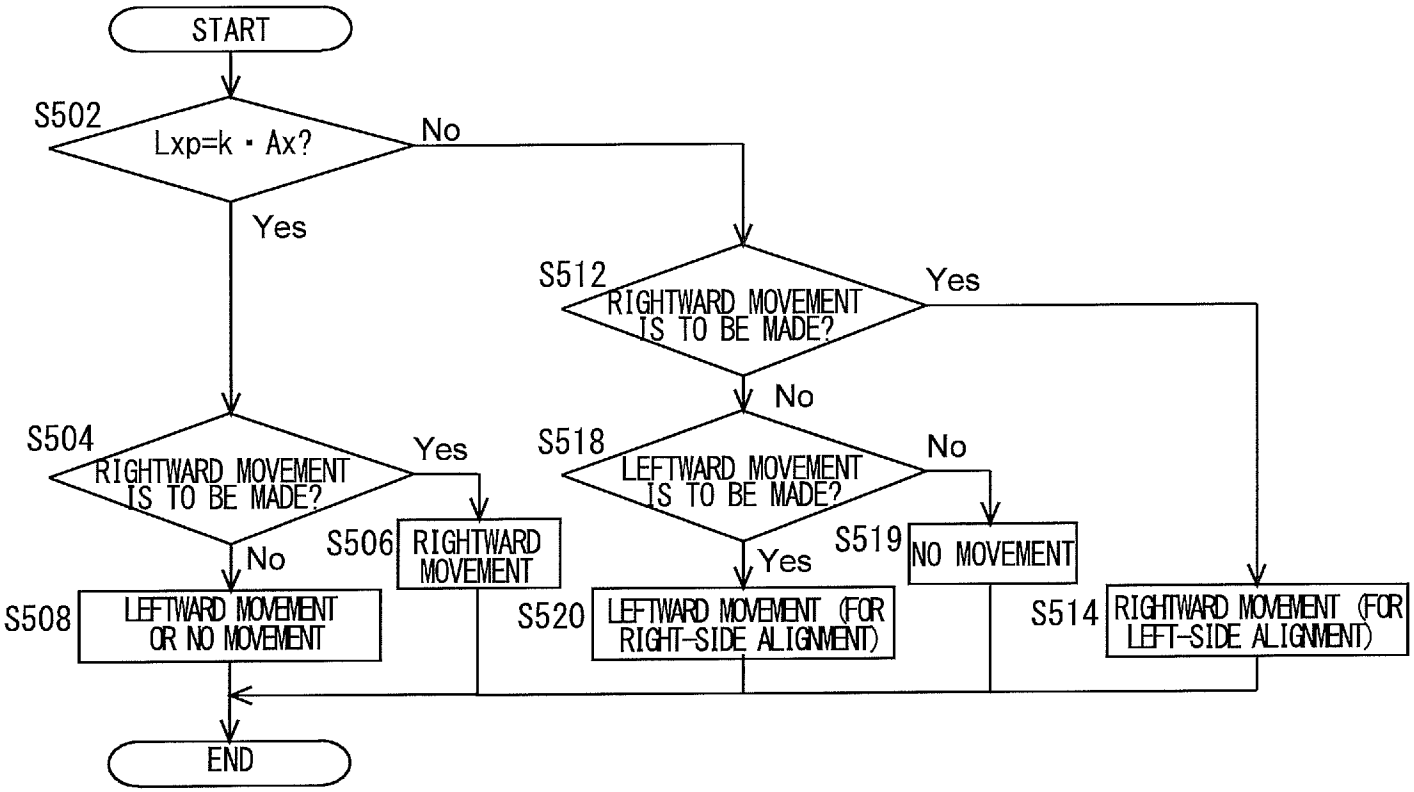
FIG. 14 is a flowchart illustrating the processing procedure for an X-coordinate correction computation process in a first major variant of the embodiment.

FIG. 14 is a flowchart illustrating the processing procedure for the X-coordinate correction computation process in the present variant. As can be appreciated from comparison, the processing of steps S502 to S520 shown in FIG. 14 is almost the same as the processing of steps S102 to S120 shown in FIG. 7. However, the processing in the present variant differs from the processing in the embodiment in that the processing of steps S110, S116, and S122 related to the subscreen size correction process is omitted, and the processing of steps S518 and S519 is added. Therefore, the following description mainly focuses on the added processing, and any descriptions of other processing will be omitted.

In step S518 shown in FIG. 14, the subscreen control section 10 determines whether or not to move the subscreen to the left. In step S112 as shown in FIG. 7, when the rightward movement is not to be made (No in step S112), the leftward movement is made, but here, even when the rightward movement is not to be made, a further determination is made regarding whether the leftward movement is not to be made, i.e., whether neither the rightward nor the leftward movement is to be made.

Concretely, where the subscreen size Lxp is represented by equation (4) mentioned above, the subscreen control section 10 determines whether at least one of equations (9) and (10) below is satisfied.

$$b/2<Ax-Xps\leq b \quad (9)$$

$$b=1 \quad (10)$$

Here, as shown in equation (4) mentioned above, the subscreen size Lxp is greater than k times the area size by b, and therefore, for example, when the subscreen is moved to the left, if the aforementioned moving distance is less than or equal to b/2, it should be appropriate to make the leftward movement. However, when such a movement causes the left side of the subscreen to move beyond the left side of the area and overlap an area adjacent on the left, backlight sources corresponding to that left area are lit up, failing to reduce the number of backlight sources to be lit up. The condition for not overlapping such a left area is that Xps is greater than or equal to (Ax−b). From this, equation (9) above can be derived. Moreover, where b=1, the number of backlight sources to be lit up cannot be reduced by moving the subscreen either leftward or rightward. From this, equation (10) above can be derived.

When the result of the determination in step S518 is that the leftward movement is to be made (Yes in step S518), the processing advances to step S520 (where the same processing as in step S120 is performed), and when the leftward movement is not to be made, i.e., no movement is to be made (No in step S518), the processing advances to step S519.

Next, in step S519, since the number of backlight sources to be lit up cannot be reduced by moving the subscreen, the subscreen control section 10 calculates Xp, the X-coordinate of the reference coordinate point for the pre-correction subscreen, as X, the post-correction X-coordinate, without modification.

Thereafter, once the correction computation process is similarly performed on all subscreens, another correction computation process is not performed until the next time the position (X-coordinate) of any input image is changed. During this, the multiscreen generation section 20 stores subscreen control information Cs, including corrected positions, received from the subscreen control section 10, determines the positions of subscreens, including new input images, in accordance with the stored values, and generates a multiscreen input image Dv.

In this manner, when the number of backlight sources to be lit up cannot be reduced by moving the subscreen either leftward or rightward, processing by which the subscreen is not moved prevents a reduction in display quality, which might occur due to the position of the subscreen being significantly moved from the original display position, as mentioned earlier.

<5.2 Second Major Variant>

In the embodiment, the areas are set by simply dividing the screen as mentioned earlier, but in the present variant, the areas are set so as to include portions overlapping their surrounding areas. Such an area is also called a seek area to be distinguishable from simply divided areas. Hereinafter, the positional relationship between such areas and their corresponding LED units 32 will be described with reference to FIG. 15.

Figure 15:
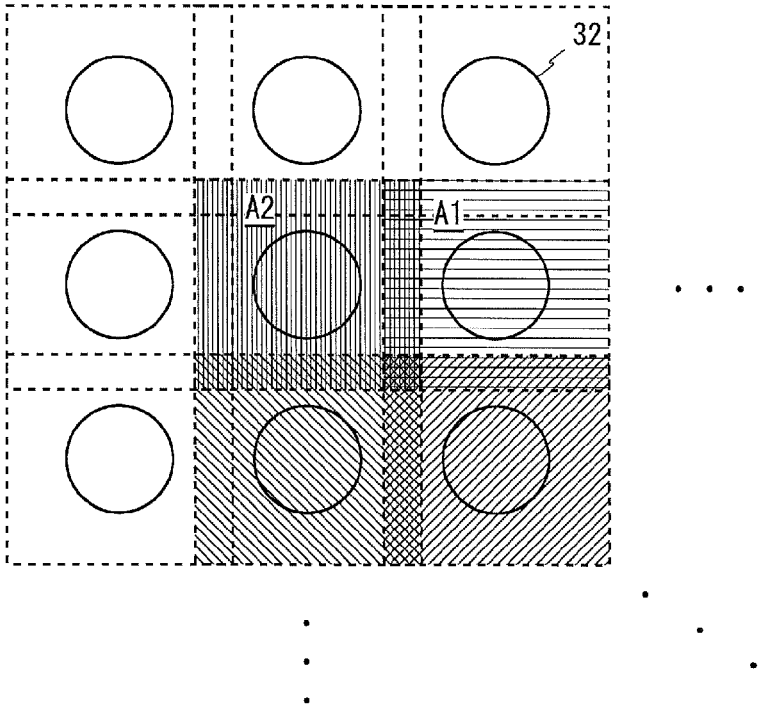
FIG. 15 is a diagram schematically illustrating the positional relationship between areas and LED units in a second major variant of the embodiment.

FIG. 15 is a diagram schematically illustrating the positional relationship between areas and LED units in the present variant. Here, the LED units 32 included in the backlight 3 have one-to-one correspondence with the areas, which are indicated by dotted lines in the figure. As can be appreciated with reference to FIG. 15, the areas are set so as to include portions overlapping their surrounding areas. Hatching is provided in the figure in order to better indicate such overlaps.

In the case where the areas are set in such a manner, for example, when a subscreen is moved to the right (in the processing of step S114) in order to cause the left side of the subscreen to coincide with the left side of a corresponding area (here, area $A_1$ in the figure), backlight sources that are to be turned off by correction computation might remain lit up since the right side of an area adjacent on the left side (here, area $A_2$ in the figure) has not yet been passed (i.e., the left side of the subscreen is within that adjacent area $A_2$).

However, in such a case, correction computation may be performed considering the left side of area $A_2$ , which is positioned to the right of the left side of corresponding area $A_1$, as the left side of corresponding area $A_l$ in step S114. Moreover, correction computation is similarly performed for other sides. As a result, correction computation can be performed in the same manner as in the embodiment, thereby achieving the same effect.

<5.3 Other Variants>

In the embodiment, a determination is made in step S406 shown in FIG. 9, regarding whether the value for the rate of reduction in the X-axis direction of the post-correction subscreen to the pre-correction is greater than the value for the rate of reduction in the Y-axis direction of the post-correction subscreen to the pre-correction (i.e., whether a change in size is smaller), and the size reduction is made both in the X-axis direction and in the Y-axis direction at the rate of reduction with a smaller size change, but in place of this determination, another determination may be made as to whether the ratio of the length of the subscreen in the Y-axis direction to the corresponding length of the area is greater than the ratio of the length of the subscreen in the X-axis direction to the corresponding length of the area.

Specifically, the number of areas that the side of the subscreen overlaps is smaller on the side that has a greater ratio of the length of the subscreen to the corresponding length of an area than on the side that has a smaller ratio. For example, in the case where a subscreen with long sides in the horizontal direction (X-axis direction) and an area with long sides in the vertical direction (Y-axis direction) are provided (i.e., in the case where Lx/Ax>Ly/Ay), the number of areas that a horizontal side (e.g., the top side) of the subscreen overlaps is greater than the number of areas that a vertical side (e.g., the left side) overlaps. Accordingly, more backlight sources can be turned off by moving the side overlapping a larger number of areas in order to reduce the size of the subscreen. Accordingly, in this case, more backlight sources can be appropriately turned off by reducing the size of the subscreen in the horizontal direction using the rate of reduction at which to reduce the size of the subscreen in the vertical direction (perpendicular to the horizontal direction) than by reducing the length in the opposite manner. Therefore, in the above example, the aforementioned determination method is used in place of step S406, (producing the same result as in the case where the determination No is made in step S406) so that the subscreen size is reduced at a rate of reduction of Ly/Lyp by the processing of step S410.

In this manner, more backlight sources can be turned off by setting the size of a subscreen so as to be reduced both in the horizontal direction and in the vertical direction using the rate of reduction in the direction perpendicular to a side of the subscreen that has a greater ratio of the length to a corresponding side of an area, thereby realizing low power consumption.

While the first major variant has been described with reference to the case where only the X-coordinate correction computation is performed, the same partial effect can be achieved even in the case where only the subscreen size correction computation process (step S400) is performed.

However, in such a case, the aforementioned coordinate correction computation process is omitted, so that there is no side corresponding to the fixed side (in the processing of step S116 or S122). Accordingly, a first size correction computation process is performed such that one (right-left direction or top-bottom direction) side of a reduced-size subscreen that overlaps a side of an area is set as a fixed side, and a second size correction computation process is performed to reduce the size of the subscreen such that an opposite side to the fixed side overlaps a side of the area. Consequently, the same result as in the embodiment can be obtained (in the right-left direction or the top-bottom direction), resulting in the entirely same effect being achieved.

In the coordinate correction computation process (steps S100 and S200) and the size correction computation process (step S400) in the embodiment, subscreens are placed so as to have their sides coinciding with sides of their nearest corresponding areas, but subscreens may be placed so as to have their sides coinciding with corresponding sides of areas within a predetermined neighboring range.

While the embodiment has been described taking as an example the straight-down or tandem backlight device having LED units arranged both in the X-axis direction and in the Y-axis direction, the present invention can be similarly applied to an edge-illuminating backlight device having light sources arranged only in the X-axis direction (or in the Y-axis direction), so long as area-active control is performed using areas provided in series in the X-axis direction (or in the Y-axis direction).

Furthermore, in the embodiment, display elements made of materials other than liquid crystal may be employed so long as their light transmittances are controllable, and the present invention can be similarly applied to image display devices including such display elements, so long as the aforementioned area-active control is performed.

INDUSTRIAL APPLICABILITY

The present invention can be applied to image display devices including backlights, and is suitable for image display devices, such as liquid crystal display devices, which have the function of controlling backlight luminance area by area.

DESCRIPTION OF THE REFERENCE CHARACTERS

2 liquid crystal display device
3 backlight
4 backlight driver circuit
5 area-active drive processing section
6 panel driver circuit
7 liquid crystal panel
10 subscreen control section
15 LED output value calculation section
16 display luminance calculation section
17 luminance spread filter
18 LCD data calculation section
20 multiscreen generation section
32 LED unit
$Dv_1$ to $Dv_3$ subscreen input image
Dv multiscreen input image
Da LCD data
Db LED data

The invention claimed is:

1. An image display device with a function of controlling a backlight luminance and a function of displaying one or more rectangular subscreens indicating one or more input images, in a display screen, comprising:

a display panel including a plurality of display elements for controlling light transmittances, the display panel having the display screen;

a backlight including a plurality of light sources;

a screen control section for determining for each of the one or more subscreens either a position in which to arrange the subscreen in the display screen or a size of the subscreen, or both;

a screen generation section for generating a combined input image in which the one or more input images are arranged in either or both of the position and the size determined by the screen control section;

an emission luminance calculation section for setting a plurality of areas corresponding to the light sources within the combined input image, and obtaining emission luminance data on the basis of the combined input image for each of the set areas, the emission luminance data indicating luminances upon emission of the light sources corresponding to the area;

a display data calculation section for obtaining display data for controlling the light transmittances of the display elements, on the basis of the combined input image and the emission luminance data obtained by the emission luminance calculation section;

a panel driver circuit for outputting signals for controlling the light transmittances of the display elements to the display panel, on the basis of the display data; and a backlight driver circuit for outputting signals for controlling the luminances of the light sources to the backlight, on the basis of the emission luminance data, wherein, the screen control section sets either the position in which to arrange the subscreen or the size of the subscreen, or both, such that a boundary of the subscreen coincides with a boundary of any one of the areas, the screen control section sets a predetermined or externally received arrangement position for the subscreen on the basis of a result of performing either or both of computation for determining a shorter moving distance between a left movement and a right movement in a horizontal moving direction within the display screen or computation for determining a shorter moving distance between an up movement and a down movement in a vertical moving direction within the display screen, so as to cause the boundary of the subscreen to coincide with the boundary of the area, and without changing a position of the boundary of the subscreen caused to coincide with the boundary of the area by moving the arrangement position of the subscreen, the screen control section sets the size of the subscreen on the basis of a result of performing computation for reducing the size such that an opposite boundary of the subscreen coincides with a corresponding opposite boundary of the area.

2. The image display device according to claim 1, wherein the screen control section sets a predetermined or externally received size of the subscreen on the basis of a result of performing either or both of computation for reducing a horizontal dimension of the display screen or computation for reducing a vertical dimension of the display screen, so as to cause the boundary of the subscreen to coincide with the boundary of the area.

3. The image display device according to claim 2, wherein, when the size of the subscreen is reduced both in the horizontal direction and the vertical direction, the screen control section computes rates of reduction in the horizontal direction and the vertical direction, and sets the size of the subscreen such that the size is reduced both in the horizontal direction and the vertical direction at the rate of reduction.

4. The image display device according to claim 2, wherein, when the size of the subscreen is reduced both in the horizontal direction and the vertical direction, the screen control section computes rates of reduction in the horizontal direction and the vertical direction, and sets the size of the subscreen such that the size is reduced both in the horizontal direction and the vertical direction at the rate of reduction for a direction perpendicular to a side of the subscreen that has a greater ratio of length to a corresponding side of the area in the horizontal or vertical dimension.

5. A method for controlling an image display device having a function of controlling a backlight luminance and a function of displaying one or more rectangular subscreens indicating one or more input images, in a display screen, the image display device being provided with a display panel including a plurality of display elements for controlling light transmittances and having the display screen, and a backlight including a plurality of light sources, the method comprising:

a screen control step of determining for each of the one or more subscreens either a position in which to arrange the subscreen in the display screen or a size of the subscreen, or both;

a screen generation step of generating a combined input image in which the one or more input images are arranged in either or both of the position and the size determined in the screen control step;

an emission luminance calculation step of setting a plurality of areas corresponding to the light sources within the combined input image, and obtaining emission luminance data on the basis of the combined input image for each of the set areas, the emission luminance data indicating luminances upon emission of the light sources corresponding to the area;

a display data calculation obtaining display data for controlling the light transmittances of the display elements, on the basis of the combined input image and the emission luminance data obtained in the emission luminance calculation step;

a panel drive step of outputting signals for controlling the light transmittances of the display elements to the display panel, on the basis of the display data; and a backlight drive step of outputting signals for controlling the luminances of the light sources to the backlight, on the basis of the emission luminance data, wherein, in the screen control step, either the position in which to arrange the subscreen or the size of the subscreen, or both, are set such that a boundary of the subscreen coincides with a boundary of any one of the areas, the screen control section sets a predetermined or externally received arrangement position for the subscreen on the basis of a result of performing either or both of computation for determining a shorter moving distance between a left movement and a right movement in a horizontal moving direction within the display screen or computation for determining a shorter moving distance between an up movement and a down movement in a vertical moving direction within the display screen, so as to cause the boundary of the subscreen to coincide with the boundary of the area, and without changing a position of the boundary of the subscreen caused to coincide with the boundary of the area by moving the arrangement position of the subscreen, the screen control section sets the size of the subscreen on the basis of a result of performing computation for reducing the size such that an opposite boundary of the subscreen coincides with a corresponding opposite boundary of the area.

6. An image display device with a function of controlling a backlight luminance and a function of displaying one or more rectangular subscreens indicating one or more input images, in a display screen, comprising:

a display panel including a plurality of display elements for controlling light transmittances, the display panel having the display screen;

a backlight including a plurality of light sources;

a screen control section for determining for each of the one or more subscreens either a position in which to arrange the subscreen in the display screen or a size of the subscreen, or both;

a screen generation section for generating a combined input image in which the one or more input images are arranged in either or both of the position and the size determined by the screen control section, an emission luminance calculation section for setting a plurality of areas corresponding to the light sources within the combined input image, and obtaining emission luminance data on the basis of the combined input image for each of the set areas, the emission luminance data indicating luminances upon emission of the light sources corresponding to the area;

a display data calculation section for obtaining display data for controlling the light transmittances of the display elements, on the basis of the combined input image and the emission luminance data obtained by the emission luminance calculation section;

a panel driver circuit for outputting signals for controlling the light transmittances of the display elements to the display panel, on the basis of the display data; and a backlight driver circuit for outputting signals for controlling the luminances of the light sources to the backlight, on the basis of the emission luminance data, wherein, the screen control section sets either the position in which to arrange the subscreen or the size of the subscreen, or both, such that a boundary of the subscreen coincides with a boundary of any one of the areas;

the screen control section sets a predetermined or externally received size of the subscreen on the basis of a result of performing either or both of computation for reducing a horizontal dimension of the display screen or computation for reducing a vertical dimension of the display screen, so as to cause the boundary of the subscreen to coincide with the boundary of the area; and when the size of the subscreen is reduced both in the horizontal direction and the vertical direction, the screen control section computes rates of reduction in the horizontal direction and the vertical direction, and sets the size of the subscreen such that the size is reduced both in the horizontal direction and the vertical direction at the rate of reduction for a direction perpendicular to a side of the subscreen that has a greater ratio of length to a corresponding side of the area in the horizontal or vertical dimension.

7. The image display device according to claim 6, wherein the screen control section sets a predetermined or externally received arrangement position for the subscreen on the basis of a result of performing either or both of computation for determining a shorter moving distance between a left movement and a right movement in a horizontal moving direction within the display screen or computation for determining a shorter moving distance between an up movement and a down movement in a vertical moving direction within the display screen, so as to cause the boundary of the subscreen to coincide with the boundary of the area.

8. The image display device according to claim 7, wherein, without changing a position of the boundary of the subscreen caused to coincide with the boundary of the area by moving the arrangement position of the subscreen, the screen control section sets the size of the subscreen on the basis of a result of performing computation for reducing the size such that an opposite boundary of the subscreen coincides with a corresponding opposite boundary of the area.

9. A method for controlling an image display device having a function of controlling a backlight luminance and a function of displaying one or more rectangular subscreens indicating one or more input images, in a display screen, the image display device being provided with a display panel including a plurality of display elements for controlling light transmittances and having the display screen, and a backlight including a plurality of light sources, the method comprising:

a screen control step of determining for each of the one or more subscreens either a position in which to arrange the subscreen in the display screen or a size of the subscreen, or both;

a screen generation step of generating a combined input image in which the one or more input images are arranged in either or both of the position and the size determined in the screen control step, an emission luminance calculation step of setting a plurality of areas corresponding to the light sources within the combined input image, and obtaining emission luminance data on the basis of the combined input image for each of the set areas, the emission luminance data indicating luminances upon emission of the light sources corresponding to the area;

a display data calculation obtaining display data for controlling the light transmittances of the display elements, on the basis of the combined input image and the emission luminance data obtained in the emission luminance calculation step;

a panel drive step of outputting signals for controlling the light transmittances of the display elements to the display panel, on the basis of the display data; and a backlight drive step of outputting signals for controlling the luminances of the light sources to the backlight, on the basis of the emission luminance data, wherein, in the screen control step, either the position in which to arrange the subscreen or the size of the subscreen, or both, are set such that a boundary of the subscreen coincides with a boundary of any one of the areas;

the screen control section sets a predetermined or externally received size of the subscreen on the basis of a result of performing either or both of computation for reducing a horizontal dimension of the display screen or computation for reducing a vertical dimension of the display screen, so as to cause the boundary of the subscreen to coincide with the boundary of the area; and when the size of the subscreen is reduced both in the horizontal direction and the vertical direction, the screen control section computes rates of reduction in the horizontal direction and the vertical direction, and sets the size of the subscreen such that the size is reduced both in the horizontal direction and the vertical direction at the rate of reduction for a direction perpendicular to a side of the subscreen that has a greater ratio of length to a corresponding side of the area in the horizontal or vertical dimension.

* * * * *